United States Patent [19]

Weinstein

[11] Patent Number: 4,875,603

[45] Date of Patent: Oct. 24, 1989

[54] METERED DISPENSING CAP FOR TUBES

[75] Inventor: Jack Weinstein, Manchester Township, Ocean County, N.J.

[73] Assignee: Primary Delivery Systems, Inc., Annandale, N.J.

[21] Appl. No.: 302,339

[22] Filed: Jan. 26, 1989

[51] Int. Cl.[4] ..... B67D 5/06

[52] U.S. Cl. ..... 222/205; 222/206; 222/207

[58] Field of Search ..... 222/205, 206, 207, 213, 222/215, 523, 525, 425, 491, 492, 493, 92, 94, 97, 434, 438

[56] References Cited

U.S. PATENT DOCUMENTS

| | | | |
|---|---|---|---|
| 1,926,367 | 9/1933 | Booth . | |
| 1,975,545 | 10/1934 | Homewood et al. | 222/205 |
| 2,205,082 | 6/1946 | Callaghan et al. . | |
| 2,591,455 | 4/1952 | Marshall . | |
| 2,904,227 | 9/1959 | Graham | 222/213 X |
| 2,980,302 | 4/1961 | Rasmussen | 222/525 X |
| 3,089,623 | 5/1963 | Padzieski . | |
| 3,179,300 | 4/1965 | Davidson et al. | 222/213 |
| 3,190,505 | 6/1965 | Arbitman et al. | 222/492 X |
| 3,220,611 | 11/1965 | Zander et al. | 222/207 |
| 3,246,807 | 4/1966 | Micallef | 222/492 X |
| 3,604,593 | 9/1971 | Curci | 222/425 X |
| 4,077,547 | 3/1978 | Donoghue . | |
| 4,162,449 | 7/1979 | Bennett | 222/207 X |
| 4,364,492 | 12/1982 | Kong . | |
| 4,376,495 | 3/1983 | Spatz . | |
| 4,437,582 | 3/1984 | Dorner | 222/94 |
| 4,518,105 | 5/1985 | Kuckens et al. . | |
| 4,548,524 | 10/1985 | Seager | 222/205 X |
| 4,732,549 | 3/1988 | von Schuckmann | 222/207 X |
| 4,795,063 | 1/1989 | Sekiguchi et al. | 222/205 X |
| 4,807,785 | 2/1989 | Pritchett | 222/525 X |

*Primary Examiner*—Joseph J. Rolla
*Assistant Examiner*—Boris Milef
*Attorney, Agent, or Firm*—Kenneth P. Glynn

[57] ABSTRACT

The present invention is directed to a metered dispensing cap system for containers such as tubes and the like. The system has a base element which is attachable to the neck of a squeezable container and which has a sidewall portion and a top. The base element has an opening in the top for outflow of a material from a squeezeable container into a meter element. This base element may be removeably attachable, e.g. by being screwed on, or may be permanently attached, e.g. by being integrally molded with the container. A one way valve is located in the opening of the base element to permit the flow of material from a container through the opening while preventing backflow. The system also includes a meter element which acts like an inverted trap and which has a sidewall portion and a top with an opening in the top for dispensing of the material therefrom. The sidewall portion of the meter element is slightly larger than and has the same across section shape as the sidewall portion of the base element and this sidewall portion of the meter element is higher than and located about and encompasses the sidewall portion of the base element. Further, the meter element is vertically slideable along the sidewall portion of the base element with an upward position for receiving a volume of material in a pre-determined amount when the squeezeable container is squeezed and downward position whereby the opening in the top of the meter element allows for dispensing of the desired amount of fluid when the meter element is pushed down.

19 Claims, 2 Drawing Sheets

METERED DISPENSING CAP FOR TUBES

BACKGROUND OF THE INVENTION

1. Field of the Invention

The present invention relates to an easy-to-use metered dispensing cap for tubes and other types of containers. In particular, this invention is directed to a cap system which permits metered amounts of material to be repeatedly dispensed as desired. By squeezing the container, the metered cap is filled as it is pushed upward; by being opened at the top and pushed downward, the cap dispenses the material and is repositioned for closing and reloading.

2. Prior Art Statement

Numerous patents describe various types if dispensing caps and the industry is inundated with various designs which are sometimes complicated in operation and/or complex to manufacture. The art goes back decades, and the following patents describe different types of dispensing caps and systems that are exemplary:

Early United States Patents were directed to metering systems involving designs which typically utilize the full length of a cylindrical chamber to create a volume for the dispensing of a liquid or a semiliquid material. U.S. Pat. Nos. 1,926,367 and 2,205,082 illustrate these types of early dispensing containers. Dispensing systems involving chambers or traps at the tops of the containers were subsequently developed and these are exemplified by U.S. Pat. Nos. 2,591,455 and 3,089,623.

More recent U.S. Patents describe measuring and dispensing caps which involve squeeze bottles and/or pump mechanisms for dispensing of liquid and semiliquid materials. Thus, U.S. Pat. Nos. 4,077,547; 4,364,492; 4,376,495 and 4,518,105 described various types of dispensing systems using trap chambers with squeezeable bottles and/or pump mechanisms.

Notwithstanding formidable prior art in the metered dispensing fluid, none of the prior art systems describe a simple metered chamber mechanism such as is described in the present invention wherein merely squeezing a bottle with a depressed cap and pumping downward for dispensing results in a simple metered dispensing of a fluid.

SUMMARY OF THE INVENTION

The present invention is directed to a metered dispensing cap system for containers such as tubes and the like. The system has a base element which is attachable to the neck of a squeezeable container and which has a sidewall portion and a top. The base element has an opening in the top for outflow of a material from a squeezeable container into a meter element. This base element may be removeably attachable, e.g. by being screwed on, or may be permanently attached, e.g. by being integrally molded with the container. A one way valve is located in the opening of the base element to permit the flow of material from a container through the opening while preventing backflow. The system also includes a meter element which acts like an inverted trap and which has a sidewall portion and a top with an opening in the top for dispensing of the material therefrom. The sidewall portion of the meter element is slightly larger than and has the same cross sectional shape as this sidewall portion of the base element and this sidewall portion of the meter element is higher than and located about and encompasses the sidewall portion of the base element. Further, the meter element is vertically slideable along the sidewall portion of the base element with an upward position for receiving a volume of material in a pre-determined amount when the squeezeable container is squeezed and downward position whereby the opening in the top of the meter element allows for dispensing of the desired amount of fluid when the meter element is pushed down.

BRIEF DESCRIPTION OF THE DRAWINGS

The present invention and further particulars will be more fully understood in the following description which is made with reference to preferred embodiments show in the drawings appended hereto, wherein.

DETAILED DESCRIPTION OF THE PRESENT INVENTION

Figure 1:
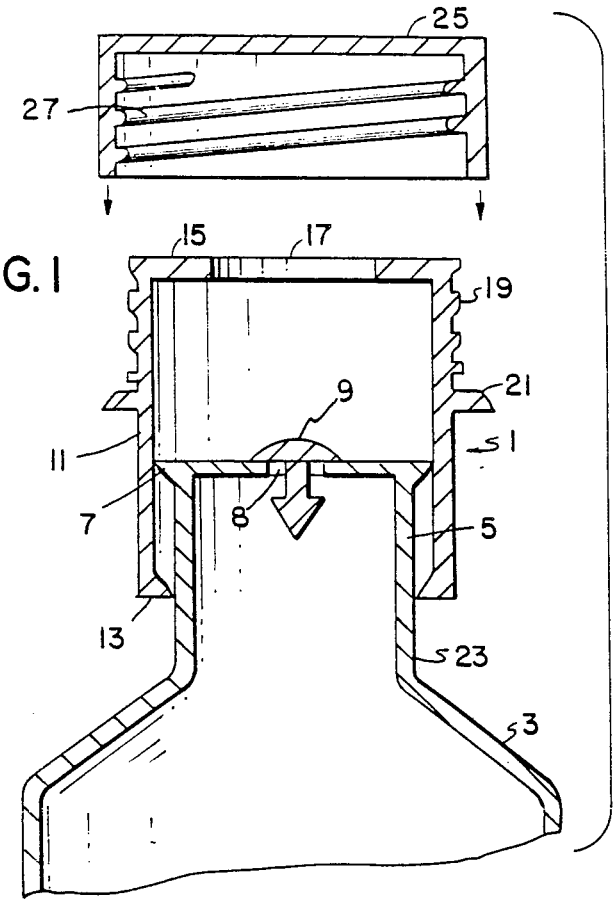
FIG. 1 illustrates a side, cut view of a squeezeable container with the base element integrally formed with the container and shows other features of a preferred embodiment of the present invention.

Referring now to the drawings, FIG. 1 shows a side, cut view of a container 3 which includes a present invention metered dispensing cap system 1. Base element five includes a sidewall portion 23 which is intrically molded to container 3 and also includes a top 7 which contains opening 8 for outflow of a material from container 3. While base element 5 is attached directly to container 3 in this embodiment, it could alternatively be removeably attached and could be snapped on or screwed on or otherwise temporarily or permenently attached to a container. Located in opening 8 is one-way valve 9 which permits flow of material from container 3 into meter element 11. Typically, this is achieved when meter element 11 is in the down position and container 3 squeezed. When this is done, one-way valve 9 opens up and allows the material in container 3 to enter into meter element 11 thereby pushing up and expanding the volume of element 11 so as to completely fill it's volume with the desired, metered amount of the material to be dispensed.

Meter element 11 includes a sidewall portion 13 which has a slightly larger diameter and the same cross sectional shape as sidewall 23, is higher than sidewall 23 and, as shown, is located around and encompasses sidewall portion 23 of base element 5. Meter element 11 has a top 15 with an opening 17 for ultimate dispensing of the metered amount of material and, in this embodiment, includes thread 19 for receiving cap 25 and also includes gripping protrusion 21, as shown. Cap 25 includes threads 27 to mesh with threads 19 so that cap 25 may removeably be attached to meter element 11. Not shown would be a bump or protrusion on wall portion 23 to prevent axial rotation of meter element 11 so as to enable cap 25 to be screwed thereon without meter element 11 rotating. Alternatively, the device may be used as shown without such a stop or bump or protrusion and cap 25 may be screwed onto meter element 11 merely by holding meter element 11 with one hand and screwing cap 25 thereon with the other hand.

Basically, meter element 11 may initially be pushed into the down position and cap 25 screwed thereon. The user would then squeeze container 23 or otherwise push material through container 23 by one-way valve 9 and would thereby expand the volume of meter element 11 while filling it up with the material to be dispensed until element 11 has slid up sidewall portion 23 as high as possible. At this point, meter element 11 would contain the full amount of material to be dispensed. The user would then remove cap 25 and push downward on protrusion 21, e.g. with two fingers, so as to force the material out of meter element 11 and out of opening 17.

While protrusion 21 is shown as a finger gripping protrusion, alternatively, other types of flange designs or wings or handles or serations could be used. Additionally, while one-way valve 9 is shown as an umbrella valve, it should be noted that any type of one-way valve could be used such as a spring loaded valve or a flap valve or any other one-way valve which would be available to the artisan. Regarding the cap 25, this does not have to be a screw on cap but could be a permanently attached flip cap, a snap cap, a stopper, a plug or any other type of known closure. Additionally, meter element 11 has a single volume as shown but could have created stop levels at various levels along sidewall 23 so as to permit, for example, a quarter dosage, a half dosage, or a three quarter dosage or full dosage thereby allowing for variable volume dispensing.

Figure 2:
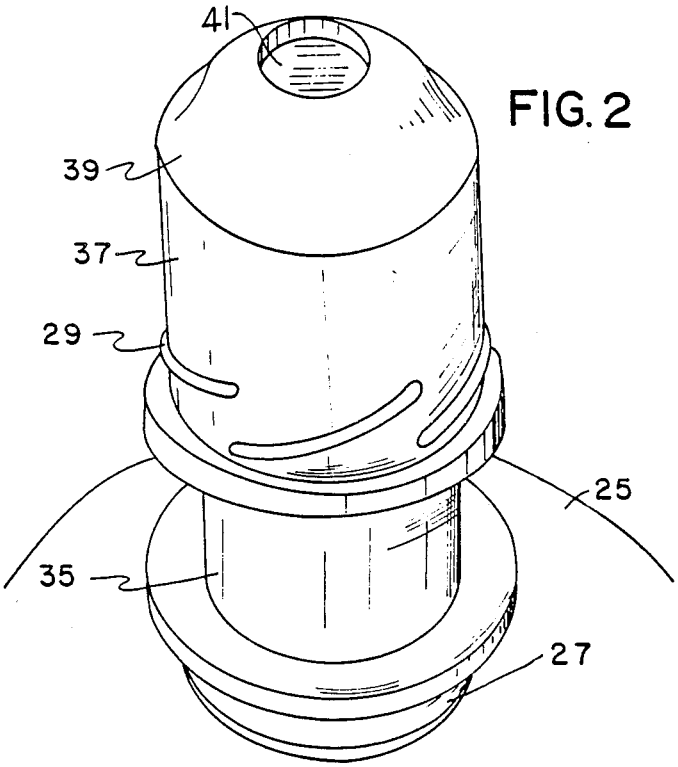
FIG. 2 shows a top oblique view of an alternative embodiment of the present invention including part of a container.

Referring now to FIG. 2, there is shown container 25 with base element 27 integrally attached thereto with sidewall portion 35 as shown. A one-way valve located inside is not shown but functions in the same manner as that shown in FIG. 1. Meter element 37 includes sidewall 29 and top portion 39 with opening 41. In this embodiment, it should be noted that top 41 is curved and no finger grips or protrusion are included. The device shown in FIG. 2 is operated in a manner identical to that in FIG. 1 except that after meter element 37 is filled, cap (not shown) is removed and the container is turned upside down and top 39 is pressed against the palm of the hand or other surface and dispensing occurs without the need for finger gripping.

Figure 3:
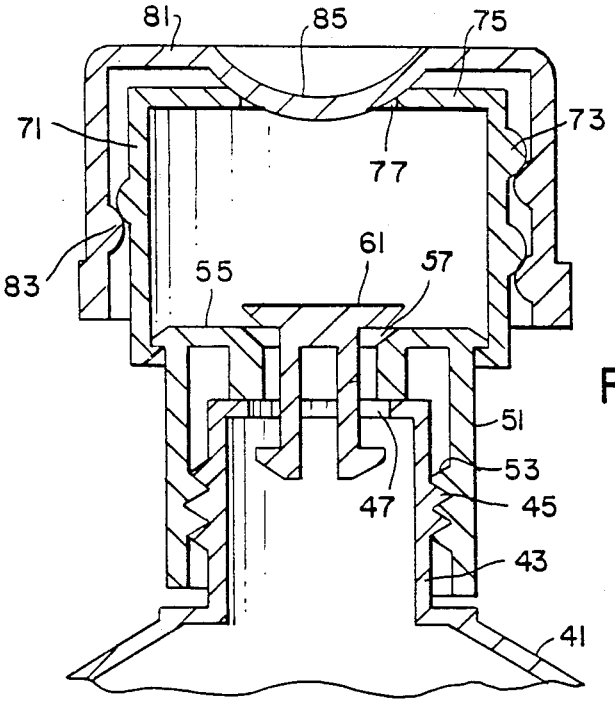
FIG. 3 shows a side, cut view of a third embodiment of the present invention wherein the base element is removeably attached (screwed on) to a container; and, FIG. 4 shows an oblique, top, partially cut view of a metered dispensing cap system of the present invention as shown in FIG. 3 but with the cap removed.

FIG. 3 shows yet another alternative embodiment of the present invention wherein a base element 51 shows the sidewall portion with threads 53 for removeably being attached to container 41 via it's threads 45 located on neck 43. Base element 51 also includes a top portion 55 and an opening 57. One-way valve 61 is included as shown. Meter element 71 includes a sidewall and a top 75 as well as an opening 77 located therein. Specially designed cap 81 has an entry in 85 in it's top and has threads 83 which mesh with threads 73 on meter element 71. This metered dispensing cap system operates in the same manner as that shown in FIG. 1 except that it is retrofitted onto a container which is already threaded.

Figure 4:
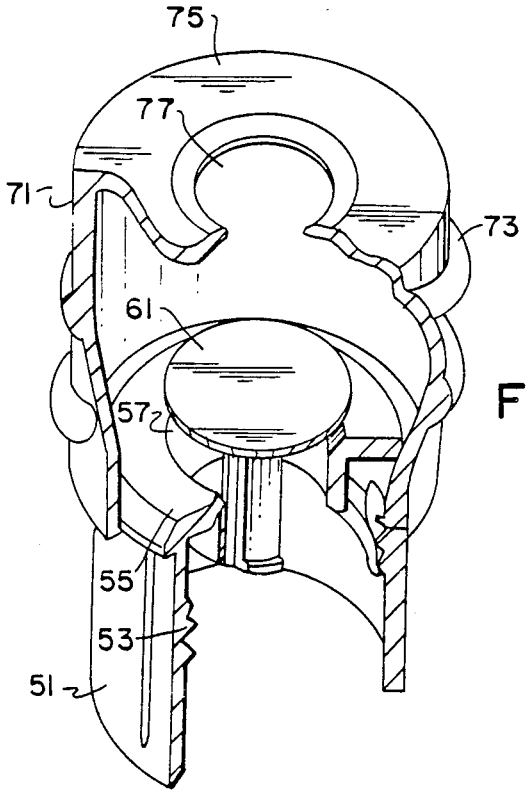

FIG. 4 shows an oblique, partially cut top view of the device shown in FIG. 3 with the cap removed. Like parts are like numbered.

Obviously, numerous modifications and variations of the present invention are possible in view of the above disclosure. Thus, while threading is shown for attachment, any known substitute may be utilized. Likewise, rather than having a base element which is intrically formed with a container, a base element could be permanently attached by heat sealing, the use of various adhesives or other means. Other changes should be seen while maintaining the function and essence of the present invention. It is therefore understood that, within the scope of the appended claims, the invention may be practiced otherwise than as specifically described herein.

What is claimed is:

1. A metered dispensing cap system for containers, which comprises:

(a) a base element attachable to the neck of a squeezeable container having a sidewall portion and a top, and having an opening in said top for outflow of a material from a squeezeable container into a meter element;

(b) a one-way valve located in said opening of said base element, permitting flow of material from a squeezeable container through said opening and preventing backflow of material back into said container;

(c) a meter element having a sidewall portion and a top, and having an opening in said top for dispensing of material from said meter element, wherein the sidewall portion is slightly larger than and has the same cross-sectional shape as the sidewall portion of said base element, wherein said sidewall portion of said meter element is higher than and located about and encompasses the sidewall portion of said base, and wherein said meter element is vertically slidable along the sidewall portion of said base element, with an upward position whereby the meter element has a predetermined volume for receiving material from the opening at the top of said base element upon squeezing a squeezeable container and a downward position whereby the top of the meter element becomes biased toward the top of the base element so as to dispense a metered amount of material through the opening at the top of said meter element; and (d) means for closing and opening the opening in the top of said metered element.

2. The metered dispenser cap system of claim 1 wherein said base element is removably attached to the neck of a squeezeable container.

3. The metered dispenser cap system of claim 2 wherein said means for opening and closing said opening in the top of said meter element is a separate cap removably attachable thereto.

4. The metered dispenser cap system of claim 2 wherein said meter element further contains protrusions for finger gripping of same to facilitate manual vertical movement thereof.

5. The metered dispenser cap system of claim 2 wherein said meter element has a rounded top to facilitate manual dispensing therefrom by pressing same against a stable surface.

6. The metered dispenser cap system of claim 2 wherein said sidewall portions of said base element and said meter element have cylindrical cross-sectional shapes.

7. The metered dispenser cap system of claim 2 wherein said system is entirely constructed of plastic materials.

8. The metered dispenser cap system of claim 1 which further comprises a squeezeable container and wherein said base element is permanently attached to said squeezeable container.

9. The metered dispenser cap system of claim 8 wherein said means for opening and closing said opening in the top of said meter element is a separate cap removably attachable thereto.

10. The metered dispenser cap system of claim 8 wherein said meter element further contains protrusions for finger gripping of same to facilitate manual vertical movement thereof.

11. The metered dispenser cap system of claim 8 wherein said meter element has a rounded top to facilitate manual dispensing therefrom by pressing same against a stable surface.

12. The metered dispenser cap system of claim 8 wherein said sidewall portions of said base element and said meter element have cylindrical cross-sectional shapes.

13. The metered dispenser cap system of claim 8 wherein said system is entirely constructed of plastic materials.

14. The metered dispenser cap systems of claim 8 wherein said base element is permanently attached to said squeezeable container by being integrally formed as a part of said container during its manufacture.

15. The metered cap system of claim 14 wherein said means for opening and closing said opening in the top of said meter element is a separate cap removably attachable thereto.

16. The metered dispenser cap system of claim 14 wherein said meter element further contains protrusions for finger gripping of same to facilitate manual vertical movement thereof.

17. The metered dispenser cap system of claim 14 wherein said meter element has a rounded top to facilitate manual dispensing therefrom by pressing same against a stable surface.

18. The metered dispenser cap system of claim 14 wherein said sidewall portions of said base element and said meter element have cylindrical cross-sectional shapes.

19. The metered dispenser cap system of claim 14 wherein said system is entirely constructed of plastic materials.

* * * * *